US010850291B2

(12) United States Patent
Toh et al.

(10) Patent No.: US 10,850,291 B2
(45) Date of Patent: Dec. 1, 2020

(54) PUMP DISPENSER AND SYSTEM COMPRISING A REFILL CARTRIDGE AND THE PUMP DISPENSER

(71) Applicant: Colgate-Palmolive Company, New York, NY (US)

(72) Inventors: Kiat-Cheong Toh, Forest Hills, NY (US); Virgil Calejesan, Brooklyn, NY (US); Andrea Brown, Minneapolis, MN (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/507,543

(22) Filed: Jul. 10, 2019

(65) Prior Publication Data

US 2019/0329275 A1 Oct. 31, 2019

Related U.S. Application Data

(63) Continuation of application No. 15/313,230, filed as application No. PCT/US2014/039176 on May 22, 2014, now Pat. No. 10,391,509.

(51) Int. Cl.
*B05B 11/00* (2006.01)
*B05B 15/30* (2018.01)

(52) U.S. Cl.
CPC ..... *B05B 11/0054* (2013.01); *B05B 11/0008* (2013.01); *B05B 11/00412* (2018.08); (Continued)

(58) Field of Classification Search
CPC ..... B05B 11/0054; B05B 11/00412; B05B 11/3045; B05B 15/30; B05B 11/0008; B65D 2231/022
See application file for complete search history.

(56) References Cited

U.S. PATENT DOCUMENTS 4,391,309 A 7/1983 Steiner
4,457,455 A 7/1984 Meshberg
(Continued)

FOREIGN PATENT DOCUMENTS

CA 1050488 3/1979
CA 2075473 8/1991
(Continued)

OTHER PUBLICATIONS

Dagmar Bleasdale, DIY Mason Jar Soap or Lotion Dispenser, www.everydayfamily.com, May 29, 2013: http://www.everydayfamily.com/blog/diy-mason-jar-soap-or-lotion-dispenser/.
(Continued)

*Primary Examiner* — Donnell A Long

(57) ABSTRACT

Disclosed is a pump dispenser comprising: a body defining a hollow interior and an opening through which at least a portion of a refill cartridge containing a flowable substance is receivable into the hollow interior; a lid; and a pump for pumping the flowable substance from the refill cartridge when the portion of the refill cartridge is in the hollow interior and the lid closes the opening. The lid comprises a dip tube with a lumen fluidly connected to the pump, the dip tube has a tapered end located in the hollow interior when the lid closes the opening. At least one of the body and the lid has a grip on an exterior surface thereof for aiding relative movement of the body and the lid to access the hollow interior when the lid closes the opening. Also disclosed is a system comprising the pump dispenser and the refill cartridge.

14 Claims, 6 Drawing Sheets

(52) U.S. Cl.
CPC ..... *B05B 11/3045* (2013.01); *B05B 15/30* (2018.02); *B65D 2231/022* (2013.01)

(56) References Cited

U.S. PATENT DOCUMENTS

| | | | | |
|---|---|---|---|---|
| 4,741,461 | A | | 5/1988 | Williamson et al. |
| 4,884,912 | A | | 12/1989 | Gueret |
| 5,042,690 | A | | 8/1991 | O'Meara |
| 5,123,571 | A | * | 6/1992 | Rebeyrolle ..... B05B 11/00412 222/105 |
| 5,439,144 | A | | 8/1995 | Holzner |
| 5,505,041 | A | | 4/1996 | Harlan |
| 5,526,960 | A | | 6/1996 | Breidenbach et al. |
| 5,875,936 | A | | 3/1999 | Turbett et al. |
| 5,938,363 | A | | 8/1999 | Timms et al. |
| 5,947,137 | A | | 9/1999 | Sheafer |
| 6,073,805 | A | | 6/2000 | Gueret |
| 6,386,403 | B2 | | 5/2002 | Parsons et al. |
| 6,666,216 | B2 | | 12/2003 | Bourjal |
| 6,874,967 | B1 | | 4/2005 | Tsaur |
| 6,929,152 | B2 | | 8/2005 | Bonningue et al. |
| 7,762,427 | B2 | | 7/2010 | Sawicki |
| 8,240,518 | B2 | | 8/2012 | Canfield |
| 8,397,951 | B2 | | 3/2013 | Moretti |
| 9,468,279 | B2 | | 10/2016 | Megaro et al. |
| 2007/0289997 | A1 | | 12/2007 | Lewis et al. |
| 2013/0264355 | A1 | | 10/2013 | Jodoin |
| 2015/0060494 | A1 | | 3/2015 | Corbett et al. |

FOREIGN PATENT DOCUMENTS

| | | |
|---|---|---|
| GB | 929331 | 6/1963 |
| GB | 1511454 | 5/1978 |
| JP | H08-290083 | 11/1996 |
| WO | 2014/050373 | 4/2014 |

OTHER PUBLICATIONS

International Search Report and the Written Opinion of the International Searching Authority issued in International Application PCT/US2014/039187 dated Jan. 22, 2015.

TNCraftCompany, Mason Jar Soap Pump, www.etsy.com, accessed Apr. 9, 2014: https://www.etsy.com/uk/transaction/146237746?

* cited by examiner

PUMP DISPENSER AND SYSTEM COMPRISING A REFILL CARTRIDGE AND THE PUMP DISPENSER

BACKGROUND

The present invention relates to a system comprising a refill cartridge and a pump dispenser for receiving the refill cartridge and dispensing a flowable substance, such as a home care product or a personal care product, from the refill cartridge, and to the pump dispenser in isolation.

It is known to provide a flowable substance, such as a personal care product, in a pump dispenser having a pump for pumping the flowable substance to an exterior of the dispenser for use by a user. However, once most of the flowable substance in such a pump dispenser has been used up, the user must dispose of the pump dispenser and obtain a new one or refill the pump dispenser by hand. Such disposal is not an efficient use of the material(s) from which the pump dispenser is made, and refilling the pump dispenser often requires opening up the pump dispenser, which can be difficult for some users, such as the elderly or those with weak hands or fingers. It is known to provide pump dispensers with refill cartridges or tanks containing a personal care product, but many known refill cartridges are difficult to open or to install in a pump dispenser, which can result in spillage of the flowable substance from the cartridge.

There is a need for a pump dispenser that is easier to refill with a flowable substance to be pumped or to replenish with a new refill cartridge. There also is a need for a pump dispenser that is easier to provide with a flowable substance to be pumped, which flowable substance may be different to a flowable substance previously pumped from the pump dispenser. There also is a need for a pump dispenser that is adapted to minimize or prevent unwanted spillage of a flowable substance from a refill cartridge when the refill cartridge is inserted therein. There further is a need for an easy to use system comprising such a pump dispenser and a refill cartridge.

BRIEF SUMMARY

An embodiment of the present invention provides a first pump dispenser, comprising: a body defining a hollow interior and an opening through which at least a portion of a refill cartridge containing a flowable substance is receivable into the hollow interior; a lid for closing the opening of the body; and a pump for pumping the flowable substance from the refill cartridge when the portion of the refill cartridge is in the hollow interior and the lid closes the opening of the body; wherein the lid comprises a dip tube with a lumen fluidly connected to the pump, the dip tube having a tapered end that is located in the hollow interior of the body when the lid closes the opening of the body.

Optionally, the tapered end of the dip tube defines an opening into the lumen.

Optionally, the dip tube is located at a center of the hollow interior of the body when the lid closes the opening of the body.

Another embodiment of the present invention provides a second pump dispenser, comprising: a body defining a hollow interior and an opening through which at least a portion of a refill cartridge containing a flowable substance is receivable into the hollow interior; a lid for closing the opening of the body; and a pump for pumping the flowable substance from the refill cartridge when the portion of the refill cartridge is in the hollow interior and the lid closes the opening of the body; wherein at least one of the body and the lid has a grip on an exterior surface thereof for aiding relative movement of the body and the lid to access the hollow interior when the lid closes the opening of the body.

Optionally, in the second pump dispenser, each of the body and the lid has a grip on an exterior surface thereof.

Optionally, in the second pump dispenser, the grip comprises a textured surface. Further optionally, the textured surface comprises a plurality of ridges and/or depressions.

Optionally, in the second pump dispenser, the grip is resilient.

Optionally, in the second pump dispenser, the grip is elastomeric.

Optionally, in either one of the first and second pump dispensers, the lid comprises the pump.

Optionally, in either one of the first and second pump dispensers, the lid and the body are relatively rotatable to attach and detach the lid to and from the body. Further optionally, the lid and the body have cooperating screw threads for retaining the lid relative to the body with the lid closing the opening of the body.

Optionally, in either one of the first and second pump dispensers, the opening of the body is circular.

Another embodiment of the present invention provides a system comprising one of the first and second pump dispensers; and the refill cartridge. The first or second pump dispenser comprised in the system may have any of the above-described optional features of the respective first and second pump dispensers.

Optionally, the refill cartridge comprises: a container defining a chamber containing the flowable substance and having a rim defining an opening through which the flowable substance is dispensable from the chamber; and a seal attached to the container and closing the opening.

Optionally, the seal comprises one of a film, a membrane, and a foil.

Optionally, the seal is puncturable by the tapered end of the dip tube when the portion of the refill cartridge is in the hollow interior and the lid is moved relative to the body to close the opening of the body.

Optionally, the seal is adhered to the container or coalesced with the container.

Optionally, the seal is attached to the rim.

Optionally, the rim comprises a flange projecting in a direction away from the opening defined by the rim.

Optionally, the flowable substance is a flowable home or personal care product.

Optionally, the personal care product is one or more of a liquid hand soap, a hand soap, a dentifrice, a hair care product, a body wash, a mouthwash a skin cream, a deodorant composition, and an antiperspirant composition, or the home care product is one or more of a laundry detergent, a dish washing detergent, a fabric softener, a fabric conditioner, a floor cleaner, and a surface cleaner.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
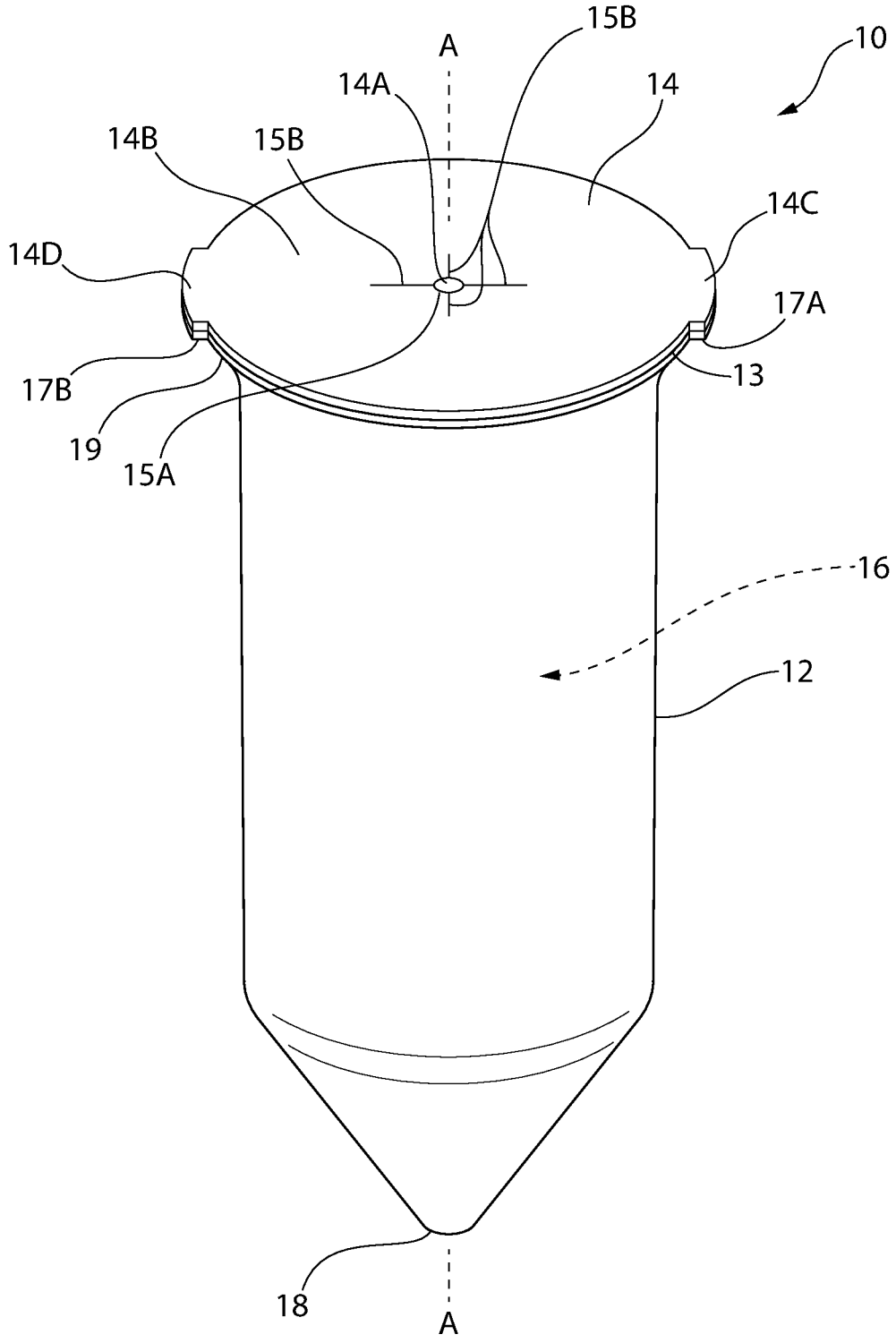
FIG. 1 is a perspective view of a refill cartridge according to an embodiment of the present invention.

FIG. 1 shows a refill cartridge 10 of an embodiment of the present invention. The refill cartridge 10 comprises a thin-walled container 12 defining a chamber 16 storing a flowable substance. Herein, by "flowable substance" it is meant a substance that is able to flow at room temperature and atmospheric pressure. Herein, by "room temperature" it is meant a temperature of 20 degrees Celsius, and by "atmospheric pressure" it is meant a pressure of 101 kPa. The flowable substance preferably is a liquid, although it could instead be any one of a paste, a powder, a gel, a foam, an emulsion and a sol. The flowable substance may comprise a flowable medium with beads suspended therein, which flowable substance may be a liquid hand soap. In this embodiment, the flowable substance is a personal care product in the form of a liquid hand soap. In variations to this embodiment, the flowable substance may be a different type of personal care product, such as one or more of a hand soap, a dentifrice, a hair care product, a body wash, a mouthwash, a skin cream, a deodorant composition, and an antiperspirant composition. In other variations to this embodiment, the flowable substance may be a home care product, such as one or more of a laundry detergent, a dish washing detergent, a fabric softener, a fabric conditioner, a floor cleaner, and a surface cleaner.

The container 12 further has a rim defining a circular opening through which the flowable substance is dispensable from the chamber 16. The rim comprises a radially-outwardly extending annular flange 13 surrounding the opening. That is, the flange 13 projects in a direction away from the opening defined by the rim. In this embodiment at least the portion of the container 12 defining the chamber 16 is flexible. In variations to the illustrated embodiment, the portion of the container 12 defining the chamber 16 may be rigid or hard. The container 12 is made from non-porous material, so that the only path from the chamber 16 to an exterior of the container 12 is via the opening. In the illustrated embodiment, the portion of the container 12 defining the chamber 16 is unitary with the flange 13. In other embodiments, the portion of the container 12 defining the chamber 16 may be non-unitary with the flange 13 but connected to the flange 13. In the illustrated embodiment, at least the portion of the container 12 defining the chamber 16 is translucent or transparent, to allow a user to see how much flowable substance remains in the chamber 16. In variations to this embodiment, the container 12 may be partially, or fully, opaque.

The chamber 16 defined by the container 12 extends over a length of the chamber 16 from a first (closed) end 18 of the container 12 to an opposite, second end 19 of the container 12 having the rim and the opening. A first cross-sectional area of the chamber 16 defined by the container 12 at a point P (see FIG. 5) furthest from the opening defined by the rim is less than 60% of a parallel maximum cross-sectional area of the chamber 16, which is located between the opening and the point P. In the illustrated embodiment, the parallel maximum cross-sectional area of the chamber 16 also can be considered to be located at the opening. In variations to the illustrated embodiment, the parallel maximum cross-sectional area may be in a region between the opening and the point P excluding the opening and the point P. In the illustrated embodiment, the first cross-sectional area is less than 10% of the maximum cross-sectional area. In variations to the illustrated embodiment, the first cross-sectional area may be less than 50%, 40%, 30% or 20% of the maximum cross-sectional area. The first cross-sectional area is less than 60% of a parallel cross-sectional area of the opening. More specifically, the first cross-sectional area is less than 10% of the cross-sectional area of the opening. In variations to the illustrated embodiment, the first cross-sectional area may be less than 50%, 40%, 30% or 20% of the cross-sectional area of the opening.

During normal use of the refill cartridge 10 in a pump dispenser 100 having a dip tube that extends into the chamber 16, as discussed below, when the flowable substance in the chamber 16 is nearly exhausted, under the influence of gravity the residual volume of the flowable substance in the chamber 16 tends to collect adjacent the first (closed) end 18 of the container 12. As a result of the first cross-sectional area being less than 60% of the maximum cross-sectional area, the residual volume is collected together in a small area, so a pump of the pump dispenser 100 is usable to extract most, and preferably all, of the flowable substance from the chamber 16. The smaller the first cross-sectional area is as compared to the maximum cross-sectional area, the more completely the pump is able to extract the flowable substance from the chamber 16, thus avoiding waste of the flowable substance.

In the illustrated embodiment, the chamber 16 defined by the container 12 tapers to an apex A (see FIG. 5) at a portion of the chamber 16 having the first cross-sectional area. That is, the first (closed) end 18 of the container 12 is shaped so as to define the apex A in the chamber 16 at a position furthest from the opening. While in the illustrated embodiment the apex A is a point apex, in variations to the illustrated embodiment the apex may be a line apex, such as a linear or curved line apex. In further variations to the illustrated embodiment, the chamber 16 instead has a uniform cross section over more than 90%, or all, of its length. In still further variations to the illustrated embodiment, the chamber 16 instead tapers to the apex A over more than 90%, or all, of its length, so that most or all of the chamber 16 may be conically-shaped. The chamber 16 has rotational symmetry about an axis A-A that passes through the apex A and the opening.

The refill cartridge 10 further comprises first and second projections 17A, 17B for holding by a user extending from the rim, and more specifically from the flange 13. Moreover, each of the projections 17A, 17B extends from the rim is a direction extending away from the opening and orthogonal to the axis A-A. The projections 17A, 17B are located on opposite sides of the opening. Since the opening is circular in the illustrated embodiment, the projections 17A, 17B can be considered diametrically opposed on opposite sides of the opening. In other embodiments in which the opening is not circular, the projections 17A, 17B may or may not be on opposite sides of the opening.

Each of the projections 17A, 17B extends along only a portion of a perimeter of the rim. That is, each of the projections 17A, 17B is perimetrically or circumferentially discontinuous. In the illustrated embodiment, each of the projections 17A, 17B extends along only about 10% of the perimeter of the rim. In other embodiments, each of the projections 17A, 17B may extend along a greater or lesser percentage of the perimeter of the rim, but it is preferred that each of the projections 17A, 17B extends along only between 1 and 25% of the perimeter of the rim, so as to provide that each of the projections 17A, 17B, and each of the notches discussed below, has structural integrity, and to provide that a user is able to hold each of the projections 17A, 17B. It is most preferred that each of the projections 17A, 17B extends along only between 5 and 15% of the perimeter of the rim.

While in the illustrated embodiment the number of projections 17A, 17B extending from the rim is only two, in other embodiments the number of projections 17A, 17B extending from the rim may be only one or more than two. For example, number of projections 17A, 17B extending from the rim may be three, four, five, six, seven, or eight.

The refill cartridge 10 further comprises a seal 14 that closes or seals the opening of the container 12. The seal 14 is a puncturable film that is attached to the container 12, and more specifically to the rim of the container 12. In variations to this embodiment, the seal 14 may be one of a membrane and a foil. In the illustrated embodiment, the seal 14 has been welded to the container 12, so that the seal 14 is coalesced with the container 12. In a variation to this embodiment, the seal 14 may be attached to the container 12 in a different way, such as by being adhered to the container 12 with an adhesive. In the illustrated embodiment, the seal 14 is opaque, but in variations to this embodiment the seal 14 may be partially or fully translucent or transparent. Prior to puncturing or removal from the container 12, the seal 14 isolates the chamber 16 and the flowable substance stored therein from an exterior of the container 12, thereby to preserve the flowable substance prior to use and to prevent unwanted dispensing or spillage of the flowable substance.

In the illustrated embodiment, a first portion 14A of the seal 14 is weaker than a second portion 14B of the seal 14. Indeed, the first portion 14A of the seal 14 is weaker than all of the remaining portion of the seal 14 that overlies, or is aligned with, the opening. In the illustrated embodiment, the first portion 14A of the seal 14 is aligned with a center of the opening, but in variations to the illustrated embodiment this may not be the case. The seal 14 further includes a third portion 14C overlying the first projection 17A and a fourth portion 14D overlying the second projection 17B. Preferably, all of the seal 14 is a unitary component, so that the first to fourth portions 14A, 14B, 14C, 14D of the seal 14 are integrally formed.

The weakened portion 14A of the seal 14 may be effected in one of a number of different ways. In some embodiments, the first portion 14A of the seal 14 comprises one or more holes in the seal 14, which reduces the structural integrity of the first portion 14A of the seal 14 as compared to other portions of the seal 14. It is preferred that the hole(s) does/do not extend fully through the seal 14, i.e. that the hole(s) extend only part way from one of the major faces of the seal 14 towards another of the major faces of the seal 14, in order that the seal 14 isolates effectively the chamber 16 and the flowable substance stored therein from the exterior of the container 12. In the illustrated embodiment, the first portion 14A of the seal 14 comprises a plurality of scores or channels 15A, 15B in the seal 14, which scores or channels 15A, 15B are holes that do not extend fully through the seal 14. Effectively the scores or channels 15A, 15B make the first portion 14A of the seal 14 thinner than the second portion 14B of the seal 14. That is, a thickness of the seal 14, which thickness is the shortest distance between major faces of the seal 14, is less at the first portion 14A of the seal 14 than at the second portion 14B of the seal 14. The scores or channels 15A, 15B lie on paths that together have the shape of a circle with a plurality of spokes extending therefrom, wherein a center of the circle lies on the axis A-A. In variations to the illustrated embodiment, the form or arrangement of the scores or channels 15A, 15B may vary.

In the illustrated embodiment, the seal 14 comprises only a single layer of material. In some variations to the illustrated embodiment, the seal 14 may comprise a plurality of layers of material, wherein the first portion 14A of the seal 14 has fewer of the layers of material than the second portion 14B of the seal 14. Accordingly, the reduced number of layers of material at the first portion 14A of the seal 14 makes the first portion 14A of the seal 14 thinner than the second portion 14B of the seal 14, and thus weaker than the second portion 14B of the seal 14. In some such variations to the illustrated embodiment, the scores or channels 15A, 15B may be omitted. Preferably each of the layers of material is of substantially the same thickness across the full extent of the layer. In some variations to the illustrated embodiment, the seal 14 may comprise only one layer that is of substantially the same thickness across the full extent of the seal 14, but the first portion 14A of the seal 14 may be made from a material that is weaker than the material of the second portion 14B of the seal 14. Alternatively, the first and second portions 14A, 14B of the seal 14 may be made from a different forms of the same material. For example, the second portion 14B of the seal 14 may be made of a substantially solid form of a material, whereas the first portion 14A of the seal 14 is made of a foamed form of the same material. Other methods of providing the weaker first portion 14A of the seal 14 will be readily apparent to the skilled person in light of the present disclosure.

The provision of the weaker first portion 14A of the seal 14 provides that the seal 14 is configured for a controlled opening by a user, when the user applies a force to the seal 14 to break the seal 14 and access the chamber 16 and the flowable substance from the exterior of the container 12, so that only a predetermined portion of the seal 14 yields. Thus, the remaining, unyielded portion of the seal 14 continues to help preserve the flowable substance prior to use and to prevent unwanted dispensing or spillage of the flowable substance.

In some embodiments, including a variation to the illustrated embodiment, the seal 14 comprises a visual indication as to the location of the first portion 14A of the seal 14 for helping a user visually identify the portion of the seal 14 that would most easily yield to an applied force, thereby to break the seal 14 and access the chamber 16 and the flowable substance from the exterior of the container 12. Such a visual indication may comprise print or paint on the seal 14.

Figure 2:
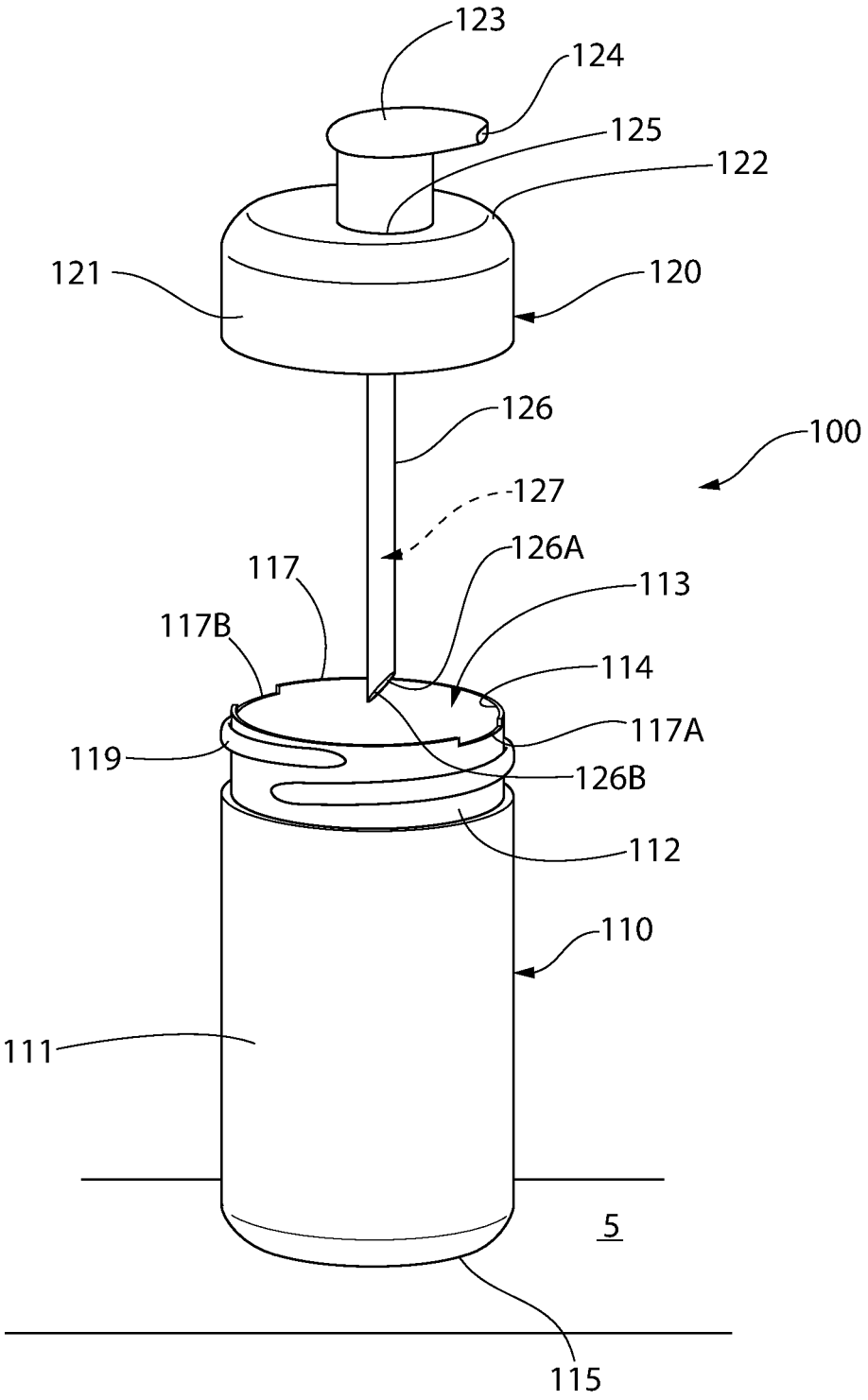
FIG. 2 is a perspective view of a pump dispenser according to an embodiment of the present invention with a lid of the pump dispenser detached from a body of the pump dispenser.

FIG. 2 shows a pump dispenser 100 of an embodiment of the present invention. The pump dispenser 100 comprises a body 110 defining a hollow interior 113 and a circular opening 114 through which at least a portion of the refill cartridge 10 is receivable into the hollow interior 113. While in the illustrated embodiment the body 110 takes the form of a vessel with access to the hollow interior 113 being possible only via the opening 114 of the body 110, in other embodiments, in addition to the opening 114, the body 110 has one or more further holes via which the hollow interior 113 is accessible from an exterior of the body 110. For example, the body 110 may take the form of an open-ended tube, a perforated container, or a container made of mesh. Such other embodiments may thus require less material to form the body 110, and/or may make the body 110 easier to manufacture, and/or may allow the container 12 (and its contents, when the container 12 is translucent or transparent) to be viewed from the exterior of the body 110. In embodiments, such as that illustrated, in which the body 110 takes the form of a vessel with access to the hollow interior 113 being possible only via the opening 114 of the body 110, the opening 114 may have a width (diameter, in the illustrated embodiment) great enough to facilitate filling of the hollow interior 113 itself with a flowable product to be dispensed using the pump, without using the refill cartridge 10. Such a width is preferably greater than or equal to 30 millimeters and less than or equal to 100 millimeters.

The body 110 includes a base 115 for supporting stably standing the pump dispenser 100 on a horizontal support surface 5. In the illustrated embodiment, the base 115 comprises a planar circular contact portion lying in a first plane for stably standing the body 110 and the rest of the pump dispenser 100 on the horizontal support surface 5. In some variations to the illustrated embodiment, the base 115 comprises an annular contact portion lying in the first plane. In some variations to the illustrated embodiment, the base 115 comprises an elliptical or polygonal contact portion. In some variations to the illustrated embodiment, the base 115 comprises a plurality of contact portions lying in the first plane. In some variations to the illustrated embodiment, the base 115 comprises one or more non-planar contact portions lying in the first plane, such as one or more point apexes or line apexes that are each a portion of a curved or non-planar surface of the body 110, yet the combination of the contact portion(s) of the base 115 enables the pump dispenser 100 to stand stably on the horizontal support surface 5. Other configurations of contact portion(s) of the base 115 will be apparent to the skilled person in light of the present disclosure.

The pump dispenser 100 further comprises a lid 120 for closing the opening 114 of the body 110, and a pump (not shown) for pumping the flowable substance from the chamber 16 of the refill cartridge 10 when the portion of the refill cartridge 10 is in the hollow interior 113 and the lid 120 closes the opening 114 of the body 110. In the illustrated embodiment, the pump (not shown) is comprised in the lid 120, but in other embodiments the pump may not be comprised in the lid 120. The pump could take any known form of pump used in conventional pump dispensers and so will not be described herein in detail. The lid 120 further comprises a main body 122 with an orifice 125 therein, a plunger 123 movably located in the orifice 125 and defining an outlet 124 in fluid communication with the pump, and a dip tube 126 that has a lumen 127 fluidly connected to the pump, as per conventional pump dispensers. The dip tube 126 has a tapered end 126A that is located in the hollow interior 113 of the body 110 when the lid 120 closes the opening 114 of the body 110. When the lid 120 closes the opening 114 of the body 110, the dip tube 126 is located at a center of the hollow interior 113 of the body 110. The tapered end 126A of the dip tube 126 defines an opening 126B into the lumen 127. Accordingly, the lumen 127 fluidly connects the opening 126B with the pump.

Herein, "tapered end" is intended to encompass arrangements in which an external diameter or width of the end 126A of the dip tube 126 is less than an external diameter or width of another portion of the dip tube 126 closer to the pump, and also arrangements (as illustrated) in which the opening 126B and an edge of the end 126A of the dip tube 126 are oblique to a longitudinal axis of the dip tube 126.

In FIG. 2, the pump dispenser 100 is shown with the lid 120 detached from the body 110. An exterior surface of the body 110 comprises a male screw thread 119 for connecting the lid 120 to the body 110. Similarly, an interior surface of the main body 122 of the lid 120 comprises a female screw thread (not shown) for mating or cooperating with the male screw thread 119 at the exterior surface of the body 110. The lid 120 is movable relative to the body 110 between first and second positions by rotating the lid 120 relative to the body 110 to engage and disengage the screw threads 119, as required. That is, the lid 120 and the body 110 are relatively rotatable to attach and detach the lid 120 to and from the body 110. The cooperating screw threads are configured to retain the lid 120 relative to the body 110 with the lid 120 closing the opening 114 of the body 110. In variations to the illustrated embodiment, the body 110 and lid 120 may be suitably modified from the embodiment of FIG. 2 so that the screw thread of the lid 120 is male and the screw thread 119 of the body 110 is female and mateable or cooperable with the screw thread of the lid 120. Moreover, in other variations to the illustrated embodiment, the lid 120 may be detachably connectable to the body 110 using mechanisms other than cooperating screw threads, such as a bayonet coupling, friction fit, or magnetically attractive materials. In such other variations to the illustrated embodiment, the screw threads 119 may be omitted.

Figure 3:
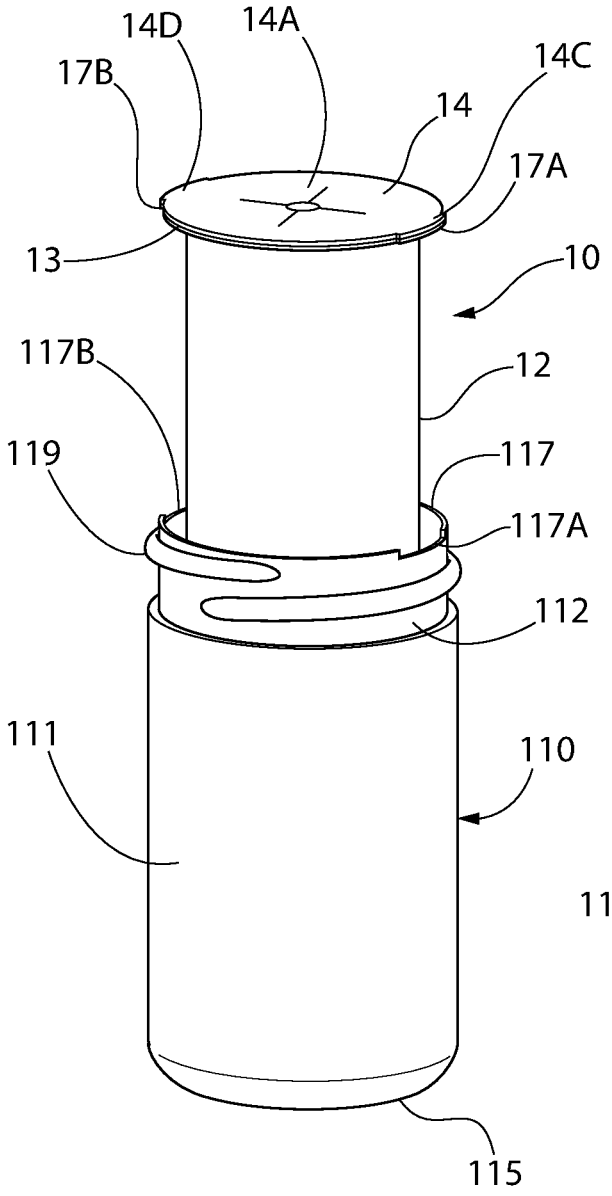
FIG. 3 is a perspective view of the refill cartridge shown in FIG. 1 being received in a hollow interior of the body of the pump dispenser shown in FIG. 2.
Figure 4:
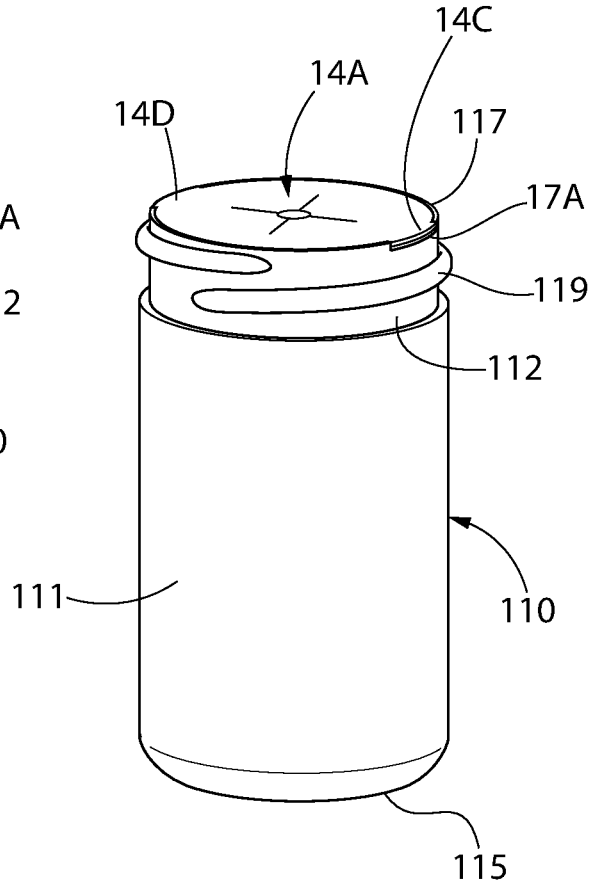
FIG. 4 is a perspective view of the refill cartridge shown in FIG. 1 received in the hollow interior of the body of the pump dispenser shown in FIG. 2.
Figure 5:
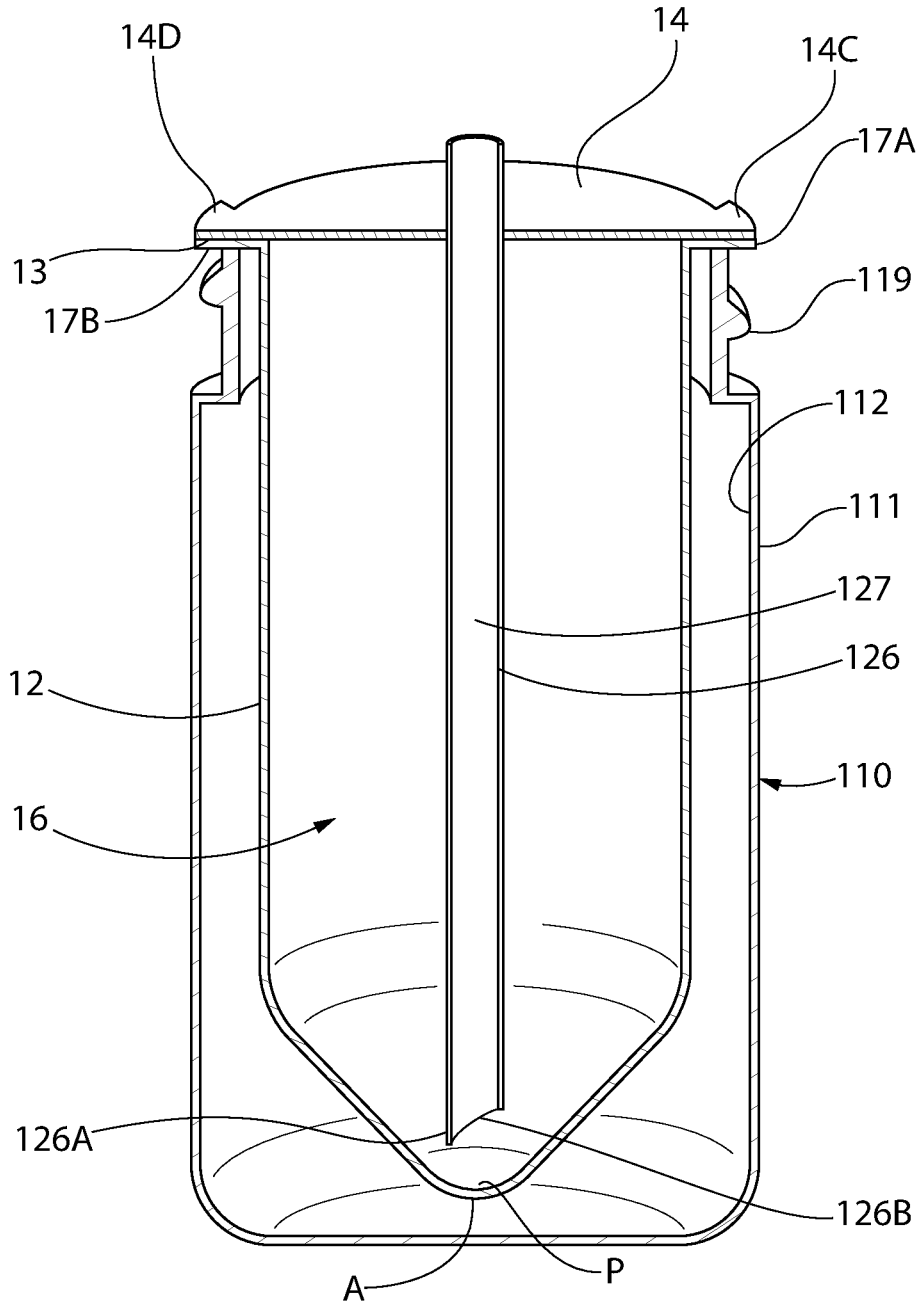
FIG. 5 is a cross section view of the components shown in FIG. 4.

As shown in FIGS. 2 to 4, the body 110 of the pump dispenser 100 has a rim 117 defining the opening 114 through which the refill cartridge 10 is receivable into the hollow interior 113 of the body 110. The rim 117 of the body 110 has first and second notches 117A, 117B therein for receiving the first and second projections 17A, 17B of the refill cartridge 10. In FIG. 3 the first and second projections 17A, 17B of the refill cartridge 10 are shown out of the first and second notches 117A, 117B, whereas in FIG. 4 the first and second projections 17A, 17B of the refill cartridge 10 are shown received in the first and second notches 117A, 117B. In the illustrated embodiment, the projections 17A, 17B and the notches 117A, 117B are relatively dimensioned so that the projections 17A, 17B extend through the notches 117A, 117B and protrude radially outward from the notches 117A, 117B when the refill cartridge 10 is in the hollow interior 113 of the body 110, as best shown in FIG. 5, yet the projections 17A, 17B do not protrude from the notches 117A, 117B to a degree sufficient to interfere with the cooperation of the screw threads 119. This permits the projections 17A, 17B to be held between thumb and finger by a user when the refill cartridge 10 is in the hollow interior 113 of the body 110 and the lid 120 is detached from the body 110, so that the user may withdraw the refill cartridge 10 from the hollow interior 113 to dispose of the refill cartridge 10, if required.

In the illustrated embodiment, the projections 17A, 17B and the notches 117A, 117B are relatively dimensioned so as to cooperate to prevent rotation of the refill cartridge 10 relative to the body 110 when the refill cartridge 10 is in the hollow interior 113 of the body 110. That is, the projections 17A, 17B and the notches 117A, 117B, i.e. respective geometry of the body 110 and the refill cartridge 10, form an anti-rotation mechanism. Such cooperation between the projections 17A, 17B and the notches 117A, 117B prevents the refill cartridge 10 rotating relative to the body 110 when the lid 120 is screwed onto the body 110. In the illustrated embodiment, the projections 17A, 17B and the notches 117A, 117B actually are relatively dimensioned so that the projections 17A, 17B are a friction fit in the notches 117A, 117B when the refill cartridge 10 is in the hollow interior 113 of the body 110. Accordingly, when the lid 120 is unscrewed and removed from the body 110, the friction fit between the projections 17A, 17B and the notches 117A, 117B prevents, or lessens the chances of, the refill cartridge 10 being inadvertently withdrawn from the hollow interior 113 as the lid 120 is moved away from the body 110 to withdraw the dip tube 126 from the chamber 16 of the refill cartridge 10. In a variation to the illustrated embodiment, the projections 17A, 17B may not be a friction fit in the notches 117A, 117B.

While in the illustrated embodiment the number of notches 117A, 117B in the rim 117 of the body 110 is only two, in other embodiments the number of notches 117A, 117B in the rim 117 of the body 110 may be only one or more than two. For example, number of notches 117A, 117B in the rim 117 of the body 110 may be three, four, five, six, seven, or eight. In some embodiments, the number of notches 117A, 117B in the rim 117 of the body 110 is greater than the number of projections 17A, 17B extending from the rim of the refill cartridge 10, in order that the refill cartridge 10 may be fully and correctly received in the hollow interior 113 in any one of a plurality of orientations relative to the body 110. Of course, preferably the number of notches 117A, 117B in the rim 117 of the body 110 is not less than the number of projections 17A, 17B extending from the rim of the refill cartridge 10, in order that the refill cartridge 10 may be fully and correctly received in the hollow interior 113. In some embodiments, such as the illustrated embodiment, the number of notches 117A, 117B in the rim 117 of the body 110 is the same as the number of projections 17A, 17B extending from the rim of the refill cartridge 10. In some such embodiments, the relative location of the notches 117A, 117B in the rim 117 and the projections 17A, 17B extending from the rim of the refill cartridge 10 may be such that the refill cartridge 10 is fully and correctly receivable in the hollow interior 113 only in one orientation relative to the body 110.

The opening 114 and hollow interior 113 of the body 110, the refill cartridge 10 and the lid 120 are relatively configured so that, when the refill cartridge 10 is in the hollow interior 113 and the lid 120 is moved in the direction of the axis A-A of the refill cartridge 10 to bring the lid 120 into contact with the body 110, the tapered end 126A of the dip tube 126 comes into contact with, and then punctures, the weaker first portion 14A of the seal 14 of the refill cartridge 10. Accordingly, the puncturing of the seal 14 is facilitated by the provision of the weaker first portion 14A of the seal 14. It will be noted that both the dip tube 126 and the first portion 14A of the seal 14 of the container 12 are aligned with a longitudinal axis of the body 110 and with a center of the opening 114 into the hollow interior 113. Moreover, as shown in FIG. 5, the dip tube 126 and the refill cartridge 10 are relatively configured so that, when the refill cartridge 10 is in the hollow interior 113 and the lid 120 is fully attached to the body 110 of the pump dispenser 100 so that the lid 120 closes the opening 114 of the body 110, the dip tube 126 extends through the seal 14 and the opening 114 of the body 110 into the chamber 16 of the refill cartridge 10, with the tapered end 126A of the dip tube 126 closer to the point P than to the opening of the container 12. Preferably, the tapered end 126A of the dip tube 126 is within 20 millimeters, and more preferably within 10 millimeters, of the first (closed) end 18 of the container 12. Optionally, the tapered end 126A of the dip tube 126 is distanced from the first (closed) end 18 of the container 12 by a distance no greater than an external diameter of the dip tube 126. Accordingly, when the residual volume of the flowable substance in the chamber 16 is adjacent the first (closed) end 18 of the container 12, as discussed above, nevertheless the pump is able to pump most or all of the residual volume of the flowable substance from the chamber 16 via the lumen 127 of the dip tube 126, thus avoiding waste of the flowable substance.

The lid 120 has a grip 121 on an exterior surface thereof for aiding relative movement of the body 110 and the lid 120 by a user to access the hollow interior 113 when the lid 120 closes the opening 114 of the body 110. In the illustrated embodiment, the grip 121 comprises a resilient sleeve 121 attached to an exterior of the main body 122 of the lid 120, which main body 122 houses the pump and has the female screw thread formed on an interior surface thereof. The resilient sleeve 121 may be elastomeric, an elastomer (such as a thermoplastic elastomer), or an elastic element. Although in the present embodiment the resilient sleeve 121 comprises a substantially smooth exterior surface, in variations to the illustrated embodiment the resilient sleeve 121 comprises a textured surface, such as a surface comprising a plurality of ridges and/or depressions. Preferably the resilient sleeve 121 has an exterior surface with a higher coefficient of friction than the main body 122 of the lid 120. In a variation to the illustrated embodiment, the lid 120 has a grip on an exterior surface thereof that is not resilient but comprises a textured surface, such as a surface comprising a plurality of ridges and/or depressions. The textured surface may be comprised on the exterior surface of a main body of the lid 120 that houses the pump and has the female screw thread formed on an interior surface thereof. Preferably the grip has an exterior surface with a higher coefficient of friction than the rest of the main body of the lid 120.

The body 110 also comprises a grip 111 on an exterior surface thereof for aiding relative movement of the body 110 and the lid 120 by a user to access the hollow interior 113 when the lid 120 closes the opening 114 of the body 110. In the illustrated embodiment, the grip 111 comprises a resilient sleeve 111 attached to an exterior of a main body 112 of the body 110, which main body 112 defines the hollow interior 113. The resilient sleeve 111 may be elastomeric, an elastomer (such as a thermoplastic elastomer), or an elastic element. Although in the present embodiment the resilient sleeve 111 comprises a substantially smooth exterior surface, in variations to the illustrated embodiment the resilient sleeve 111 comprises a textured surface, such as a surface comprising a plurality of ridges and/or depressions. Preferably the resilient sleeve 111 has an exterior surface with a higher coefficient of friction than the main body 112 of the body 110. In a variation to the illustrated embodiment, the body 110 has a grip on an exterior surface thereof that is not resilient but comprises a textured surface, such as a surface comprising a plurality of ridges and/or depressions. The textured surface may be comprised on the exterior surface of a main body of the body 110 that defines the hollow interior 113. Preferably the grip has an exterior surface with a higher coefficient of friction than the rest of the main body of the body 110.

In variations to the illustrated embodiment, one or both of the grips 111, 121 may be omitted. That is, the body 110 may have a grip on an exterior surface thereof and/or the lid may have a grip on an exterior surface thereof, or neither the body nor the lid has a grip on an exterior surface thereof.

Figure 6:
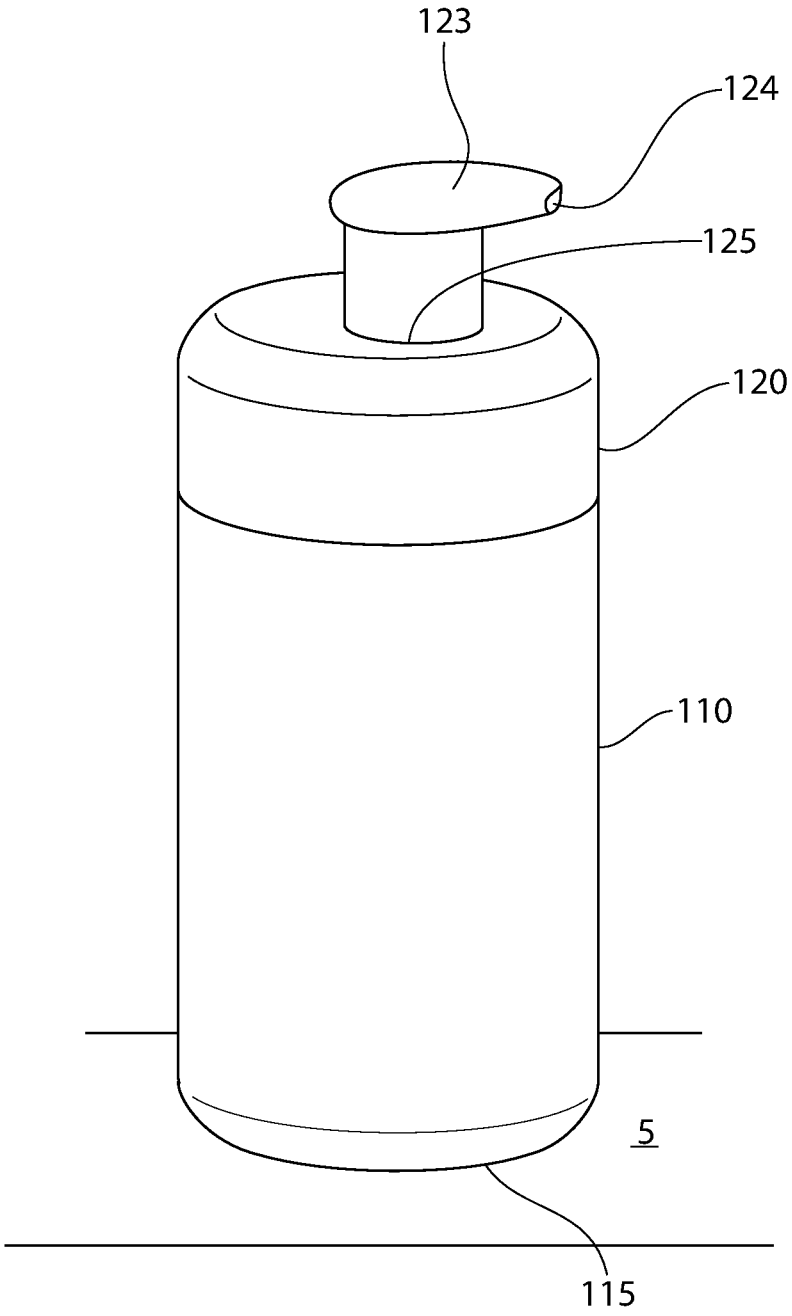
FIG. 6 is a perspective view of the pump dispenser of FIG. 2 with the lid of the pump dispenser attached to the body of the pump dispenser.

Assembly of a system comprising the refill cartridge 10 shown in FIG. 1 and the pump dispenser 100 shown in FIG. 2 will now be described. First, if required, the lid 120 and the body 110 of the pump dispenser 100 are detached from one another, as shown in FIG. 2, so as to place the hollow interior 113 of the body 110 in fluid communication with the exterior of the body 110 via the opening 114 and so as to permit a portion of the refill cartridge 10 to be inserted into the hollow interior 113. The container 12 of the refill cartridge 10 is then inserted into the hollow interior 113 of the body 110 via the opening 114 of the body 110 towards the base 115 of the body 110 until the projections 17A, 17B are received in the notches 117A, 117B, as shown in FIGS. 4 and 5. Next, the lid 120 is detachably secured to the body 110 by rotating the lid 120 relative to the body 110 while mating the male screw thread 119 of the body 110 with the female screw thread (not shown) of the lid 120, as shown in FIG. 6. During this step, the tapered end 126A of the dip tube 126 punctures the seal 14 of the refill cartridge 10 to fluidly connect the chamber 16 of the refill cartridge 10 with the pump via the lumen 127 of the dip tube 126. When a user wishes to use the pump dispenser 100, they push a top of the plunger 123 in a direction towards the main body 122 of the lid 120, so that the outlet 124 moves towards the main body 122 and the plunger 123 moves within the orifice 125 in the main body 122 of the lid 120 to actuate the pump. They then release the plunger 123 and a resilient mechanism of the pump moves the plunger 123 in a reverse direction to its original position. Repeated pushing and releasing of the plunger 123 causes the pump to pump the flowable substance from the chamber 16 of the refill cartridge 10 through the lumen 127 and out of the outlet 124 to an exterior of the pump dispenser 100. That is, there is a net flow of the flowable substance from the chamber 16 to the outlet 124.

The refill cartridge 10 in the hollow interior 113 can be replaced at any time, such as when most or all of the flowable substance in the chamber 16 has been dispensed, or when a user wishes to replace the refill cartridge 10 with another refill cartridge containing a different flowable substance to that in the refill cartridge 10. To do this, the user detaches the lid 120 from the body 110 by rotating the lid 120 relative to the body 110 to disconnect the male screw thread 119 of the body 110 from the female screw thread of the lid 120. The user then removes the refill cartridge 10 from the hollow interior 113 of the body 110 and disposes of the refill cartridge 10. Preferably the refill cartridge 10 is made of a recyclable material, and the user sends the refill cartridge 10 for recycling. The user then re-assembles the pump dispenser 100 in the manner discussed above, but using a different refill cartridge 10, such as a new, full refill cartridge 10. Accordingly, since the refill cartridge 10 may be disposed of without disposing of the whole pump dispenser 100 (i.e. without also dispensing of the body 110 and lid 120 including the pump), much of the pump dispenser 100 is re-usable, which is a more efficient use of the materials from which the pump dispenser 100 is made.

After or prior to full assembly of the apparatus as discussed above, the pump dispenser 100 and the refill cartridge 10 together can be considered a system. In some cases, the pump dispenser 100 may be supplied without any refill cartridge 10, so that the refill cartridge 10 is supplied separately from the rest of the system. Indeed, a plurality of refill cartridges 10 may be bundled or packaged together for purchase by a user, in order for the user to be able to insert and use each of the plurality of refill cartridges 10 in turn into the hollow interior 113 of the body 110.

Figure 7:
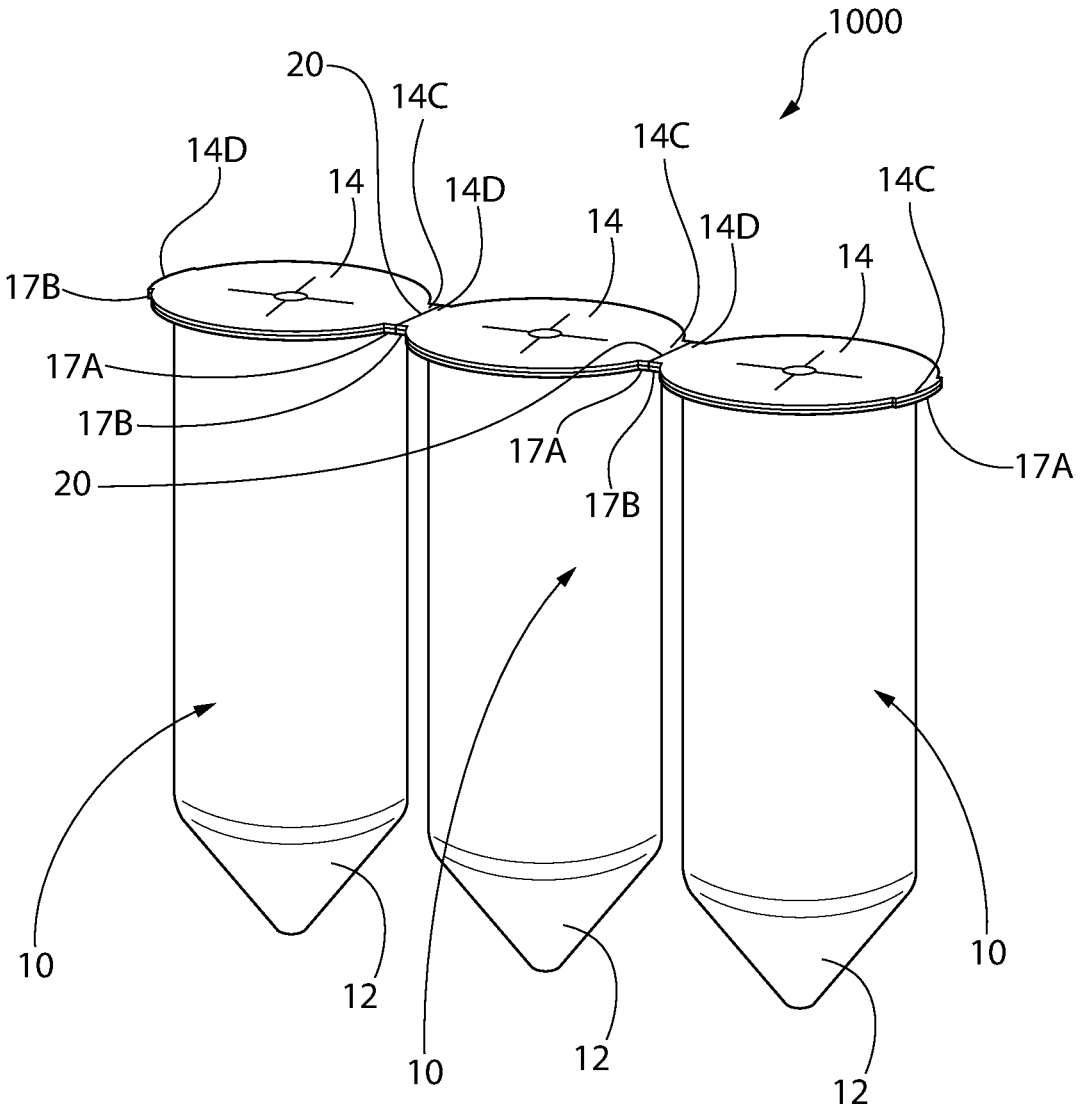
FIG. 7 is a perspective view of a combination of refill cartridges, each of the refill cartridges being as shown in FIG. 1.

For example, as shown in FIG. 7, several of the refill cartridges 10 may be detachably connected to each other to form a combination 1000 of refill cartridges. The illustrated combination 1000 comprises three refill cartridges 10, each of which is as shown in FIG. 1. The first projection 17A of a first (the far-left refill cartridge in FIG. 7) of the three refill cartridges 10 is detachably connected to the second projection 17B of a second (the middle refill cartridge in FIG. 7) of the three refill cartridges 10. Similarly, the first projection 17A of the second of the three refill cartridges 10 is detachably connected to the second projection 17B of a third (the far-right refill cartridge in FIG. 7) of the three refill cartridges 10. More specifically, the first projection 17A of the first refill cartridge 10 is detachably connected to the second projection 17B of the second refill cartridge 10 by a first member 20 that is weaker than each of the first projection 17A of the first refill cartridge 10 and the second projection 17B of the second refill cartridge 10, and the first projection 17A of the second refill cartridge 10 is detachably connected to the second projection 17B of the third refill cartridge 10 by a second member 20 that is weaker than each of the first projection 17A of the second refill cartridge 10 and the second projection 17B of the third refill cartridge 10. The first and second members 20 preferably are unitary with, i.e. integrally formed with, the projections 17A, 17B of the three refill cartridges 10.

The weakness of the first and second members 20 may be effected in one of a number of different ways. In some embodiments, such as that illustrated in FIG. 7, each of the first and second members 20 comprises one or more holes in or through the member 20, which reduces the structural integrity of the member 20 as compared to the adjacent projections 17A, 17B of the refill cartridges 10. In the illustrated embodiment, each of the first and second members 20 comprises a score or channel that does not extend fully through the member 20. Effectively the scores or channels make the members 20 thinner than the adjacent projections 17A, 17B of the refill cartridges 10. That is, a thickness of each of the members 20, which thickness is the shortest distance between major faces of the respective members 20, is less than a thickness of the adjacent projections 17A, 17B of the refill cartridges 10.

In other embodiments, the members 20 may be made from a different forms of the material from which the adjacent projections 17A, 17B of the refill cartridges 10 are made. For example, the projections 17A, 17B of the refill cartridges 10 may be made of a substantially solid form of a material, whereas the members 20 are made of a foamed form of the same material. Other methods of providing the weaker member 20 between the projections 17A, 17B of the refill cartridges 10, and indeed other ways of detachably connecting the projections 17A, 17B of adjacent refill cartridges 10, will be readily apparent to the skilled person in light of the present disclosure.

While in the illustrated embodiment the number of refill cartridges in the combination is only three, in other embodiments the number of refill cartridges 10 in the combination may be only one or more than two. For example, number of refill cartridges 10 in the combination may be three, four, five, six, seven, or eight. Each of the refill cartridges 10 may contain the same flowable substance, or one or more of the refill cartridges 10 may contain a different flowable substance to one or more of the other refill cartridges 10. For example, the different substances may have different fragrances and/or colors and/or tastes and/or active agents. Each of the refill cartridges 10 may have on an exterior surface thereof a visual indication of the flowable substance contained in the refill cartridge 10. The combination 1000 of refill cartridges 10 may be provided in a further package, such as a bag, box, carton or blister pack.

Whereas in the illustrated embodiment the container 12 has a rim defining a circular opening, in variations to the illustrated embodiment, the rim of the container 12 may instead define an opening of a different shape, such as an ellipse, a polygon, a square, a triangle, a rectangle, an oblong, a hexagon, an octagon, a squircle (a square with rounded corners), or a polygon with arced sides. In the illustrated embodiment, the container 12 has a circular cross-sectional shape. In variations to the illustrated embodiment, the container 12 may have a different cross-sectional shape, such as an ellipse, a polygon, a square, a triangle, a rectangle, an oblong, a hexagon, an octagon, a squircle (a square with rounded corners), or a polygon with arced sides. Whereas in the illustrated embodiment the body 110 defines a circular opening 114, in variations to the illustrated embodiment, the body 110 may define an opening 114 of a different shape, such as an ellipse, a polygon, a square, a triangle, a rectangle, an oblong, a hexagon, an octagon, a squircle (a square with rounded corners), or a polygon with arced sides. Preferably, but not essentially, the shape of the opening 114 of the body 110 is the same as the shape of the opening defined by the rim of the container 12 and/or the same as the cross-sectional shape of the container 12.

In embodiments of the invention in which the opening 114 is not circular, still the lid 120 and body 110 may have cooperating screw threads, or still there may be provided a friction fit between the lid 120 and body 110, for retaining the lid 120 relative to the body 110 with the lid 120 closing the opening 114 of the body 110. In other embodiments of the invention in which the opening 114 is not circular, the lid 120 may be configured to be able rest on the body 110 with the lid 120 closing the opening 114 of the body 110.

In variations to the illustrated embodiment, the refill cartridges 10 of the combination 1000 may be detachably connected together other than by the projections 17A, 17B. For example, in some embodiments of the combination 1000, the refill cartridges 10 do not comprise the projections 17A, 17B. In some embodiments, the refill cartridges 10 may be detachably connected together by the seals 14 of respective ones of the refill cartridges 10 being detachably connected together in addition to, or instead of, the projections 17A, 17B. For example, the refill cartridges 10 may be detachably connected together by the third and fourth portions 14C, 14D of the seals 14 of respective ones of the refill cartridges 10 being detachably connected together.

In variations to the illustrated embodiment, such as those in which the refill cartridge 10 does not comprise the projections 17A, 17B, the system comprising the refill cartridge 10 and the pump dispenser 100 may comprise an alternative anti-rotation mechanism for preventing rotation of the refill cartridge 10 relative to the body 110 when the portion of the refill cartridge 10 is in the hollow interior 113. Such an alternative anti-rotation mechanism may comprise respective geometry of the body 110 and of the refill cartridge 10. For example, the container 12 and the body 110 may be relatively dimensioned so as to cooperate to prevent rotation of the refill cartridge 10 relative to the body 110 when the refill cartridge 10 is in the hollow interior 113 of the body 110.

What is claimed is:

1. A system, comprising:

a pump dispenser comprising:

a body defining a hollow interior and an opening through which at least a portion of a refill cartridge containing a flowable substance is receivable into the hollow interior;

a pump for pumping the flowable substance from the refill cartridge when the portion of the refill cartridge is in the hollow interior; and a dip tube with a lumen fluidly connected to the pump, the dip tube having a tapered end that is located in the hollow interior of the body when the pump dispenser is positioned over the body and the refill cartridge; and the refill cartridge, wherein the refill cartridge comprises a container defining a chamber containing the flowable substance, a rim defining an opening through which the flowable substance is dispensable from the chamber, and a seal attached to the container and closing the opening, wherein the seal is attached to the rim, wherein the seal is puncturable by the tapered end of the dip tube when the portion of the refill cartridge is in the hollow interior.

2. The system of claim 1, wherein the seal is attached to a rim defining the opening of the refill cartridge.

3. The system of claim 1, wherein the rim comprises a flange projecting in a direction away from the opening defined by the rim.

4. The system of claim 1, wherein the seal consists of one of a film, a membrane, and a foil.

5. The system of claim 1, wherein the tapered end of the dip tube defines an opening into the lumen.

6. The system of claim 1, wherein the pump dispenser comprises a lid configured to close the opening of the body.

7. The system of claim 6, wherein the dip tube is located at a center of the hollow interior of the body when the lid closes the opening of the body.

8. The system of claim 6, wherein the lid comprises the pump.

9. The system of claim 6, wherein the lid and the body have cooperating screw threads for retaining the lid relative to the body with the lid closing the opening of the body.

10. The system of claim 1, wherein the opening of the body is circular.

11. The system of claim 1, wherein the flowable substance is a flowable home or personal care product, and wherein the personal care product is one or more of a liquid hand soap, a hand soap, a dentifrice, a hair care product, a body wash, a mouthwash, a skin cream, a deodorant composition, and an antiperspirant composition, or wherein the home care product is one or more of a laundry detergent, a dish washing detergent, a fabric softener, a fabric conditioner, a floor cleaner, and a surface cleaner.

12. The system of claim 1, wherein a first cross-sectional area of the chamber at a point furthest from the opening defined by the rim is smaller than a parallel maximum cross-sectional area of the chamber, which is located between the opening and the point furthest from the opening.

13. A kit, comprising:

a pump dispenser comprising a body defining a hollow interior and an opening through which at least a portion of a refill cartridge containing a flowable substance is receivable into the hollow interior, a pump for pumping the flowable substance from the refill cartridge when the portion of the refill cartridge is in the hollow interior, and a dip tube with a lumen fluidly connected to the pump, the dip tube having a tapered end that is located in the hollow interior of the body when the pump dispenser is positioned over the body and the refill cartridge; and the refill cartridge, wherein the refill cartridge comprises a container defining a chamber containing the flowable substance, a rim defining an opening through which the flowable substance is dispensable from the chamber, and a seal attached to the container and closing the opening, wherein the seal is attached to the rim, the seal being puncturable by the tapered end of the dip tube when the portion of the refill cartridge is in the hollow interior and the pump is inserted into said refill cartridge.

14. The kit of claim 13, further comprising a plurality of the refill cartridges.

* * * * *